US006598613B2

(12) United States Patent
Fritzche et al.

(10) Patent No.: US 6,598,613 B2
(45) Date of Patent: Jul. 29, 2003

(54) PNEUMATIC WALL STRUCTURE AND A METHOD OF MAKING AND ERECTING SAME

(75) Inventors: Albert Fritzche, Markdorf (DE); Peter Geiselhart, Meersburg (DE)

(73) Assignee: Dornier GmbH, Friedrichafen (DE)

( * ) Notice: Subject to any disclaimer, the term of this patent is extended or adjusted under 35 U.S.C. 154(b) by 0 days.

(21) Appl. No.: 09/910,947

(22) Filed: Jul. 24, 2001

(65) Prior Publication Data

US 2003/0019515 A1 Jan. 30, 2003

(51) Int. Cl.[7] ..... E04H 15/36; E04H 15/20
(52) U.S. Cl. ..... 135/124; 52/2.18
(58) Field of Search ..... 135/124–126, 135/156, 115; 52/2.18, 211, 2.13

(56) References Cited

U.S. PATENT DOCUMENTS

| | | | | |
|---|---|---|---|---|
| 2,649,101 A | * | 8/1953 | Suits | 52/2.11 X |
| 2,743,510 A | * | 5/1956 | Mauney et al. | 52/2.11 X |
| 3,240,217 A | * | 3/1966 | Bird et al. | 52/2.11 X |
| 3,375,321 A | * | 3/1968 | Laing | 52/2.11 |
| 3,660,951 A | | 5/1972 | Cadwell et al. | |
| 3,909,992 A | * | 10/1975 | Stachiw | 52/2.11 |
| 4,004,380 A | * | 1/1977 | Kwake | 52/2.11 |
| 5,097,548 A | * | 3/1992 | Heck et al. | 5/414 |
| 6,282,842 B1 | * | 9/2001 | Simens | 52/2.11 |
| 6,282,843 B1 | * | 9/2001 | Shibaike et al. | 52/2.11 |

FOREIGN PATENT DOCUMENTS

| | | |
|---|---|---|
| EP | 0359691 | 3/1990 |
| FR | 2707687 | 1/1995 |
| GB | 2008646 | 6/1979 |

OTHER PUBLICATIONS

Kawaguchi, Mamoru, Architecture and Science, The Opposite Path—Otto Frei at the 65th Birthday, "Pneumatic Constructions", Arcus, vol. 10, No. 245, pp. 1–22.

* cited by examiner

*Primary Examiner*—Daniel P. Stodola
*Assistant Examiner*—Hugh B. Thompson
(74) *Attorney, Agent, or Firm*—Crowell & Moring LLP

(57) ABSTRACT

A pneumatic wall structure and a method of making and erecting same. The pneumatic wall structure includes an inner flexible tent sheet, a central flexible tent sheet and an outer flexible tent sheet. The inner, the central and the outer flexible tent sheets are arranged to form a two-layer wall structure comprising (i) an inner layer formed by the inner tent sheet and the central tent sheet and, (ii) an outer layer formed by the central tent sheet and the outer tent sheet. The inner layer is inflatable and provides a main support structure for the wall structure, and the outer layer forms a convection space into which an ambient air is capable of flowing. The inflatable support tubes are arranged between the central tent sheet and the outer tent sheet to provide redundancy to the main support structure and to provide a spacer between the central tent sheet and the outer tent sheet.

16 Claims, 4 Drawing Sheets

PNEUMATIC WALL STRUCTURE AND A METHOD OF MAKING AND ERECTING SAME

BACKGROUND AND SUMMARY OF THE INVENTION

The invention relates to a pneumatic wall structure and a method of making and erecting same. The invention is suitable for worldwide use under extreme climatic conditions and is highly mobile. The wall structure can be used as an add-on to an existing shelter having fixed walls. It is also possible to erect a complete building enclosed on several sides from the pneumatic wall structure of the present invention.

Pneumatic structures are closely associated with the architect Frei Otto. An overview of his work is provided, for instance, in M. Kawaguchi: Der umgekehrte Weg, arcus Architektur und Wissenschaft 10 (1990).

Tubes (rafters) filled with compressed air and optionally secured with braces can also be used as support structures for pneumatic buildings.

The heat transfer coefficients of such pneumatic structures are generally considered as moderate to poor. Furthermore, sun protection and CBR protection require additional covering, which in turn prolongs the erection time. For emergency medical use, which places high demands on mobility, erection time and packing volume, adds substantial additional transport volume and weight. A pneumatic building set up as an operating room or an intensive care unit, for example, must be supplied not only with electricity for the medical equipment, but also with air-conditioning. Accordingly, it is advantageous to decrease the start-up times required for the erection of the buildings themselves, the equipment, as well as the startup time for the energy supply and the air-conditioning.

A decrease in start-up time can be achieved if the energy requirement for the air-conditioning is reduced, i.e., if thermal insulation is improved and the erection and dismantling process is at least partially automated.

The present invention achieves at least these goals by providing a pneumatic wall structure comprising an inner flexible tent sheet, a central flexible tent sheet and an outer flexible tent sheet. The inner, the central and the outer flexible tent sheets are arranged to form a two-layer wall structure comprising (i) an inner layer formed by the inner tent sheet and the central tent sheet and, (ii) an outer layer formed by the central tent sheet and the outer tent sheet. The inner layer is inflatable and provides a main support structure for the wall structure, and the outer layer forms a convection space into which an ambient air is capable of flowing. The inflatable support tubes are arranged between the central tent sheet and the outer tent sheet to provide redundancy to the main support structure and to provide a spacer between the central tent sheet and the outer tent sheet.

While retaining the pneumatic construction principles "air-supported structure" and "inflatable structure (support tube structure)" (for definitions see M. Kawaguchi loc. cit.), the present invention includes a two-layer wall structure made of 3 tent sheets (inner, outer and central tent sheet). The inner layer, preferably having a pressure of about 300 Pa above atmospheric pressure, forms the main support structure of the wall structure. Advantageously, the delimiting tent sheets (inner and central tent sheet) are connected by flexible ribs for stability, spacing and for suppressing convection currents. Stability is achieved by way of a slight overpressure within the interior due to a fresh air supply of the air conditioning system.

The second outer air layer between the central and outer tent sheet communicates with ambient air through air intake openings and air outlet openings near a floor and in a ridge area (e.g., air intake or air outlet screens). If the outer tent sheet is heated compared to the ambient temperature as a result of solar radiation, a rising convection current starts within the chambers along all the outer walls of the building.

Pressurized support tubes act as spacers while at the same time acting as a secondary, redundant support structure between the central and the outer tent sheets. The support tubes can be inflated individually.

If high solar radiation is expected, it may be advantageous to distinctly limit the heat transfer from the outer tent sheet exposed to the sun (olive green for military applications) to the interior. This may be accomplished by metallizing the central tent sheet on the surface facing the exterior by a suitable metallic coating or by vapor deposition in the wavelength range of the thermal radiation.

With the double air layer construction according to the invention, heat transfer is clearly reduced compared to a single tent sheet arrangement. Even for areas exposed to the sun, the cooling capacity is determined only by the difference between ambient temperature and interior room temperature (and not by the difference between surface temperature and interior room temperature).

A further advantageous embodiment forms the base of a pneumatic building formed with the pneumatic wall structure of the present invention as square as possible and the shape of the building as seen in a vertical cross section as elliptical or curved in some other way, so that along the edge area the interior height is just sufficient and in the center it is no higher than required for an adequate standing height and the mounting of the air distribution unit.

The object of shortening the erection time and reducing the number of required personnel during assembly is achieved since, after manually unrolling the building package, first the inner, load-bearing, segmented air chambers of the inner layer are pressurized by way of a programmably controlled air compressor or similar device as would be appreciated by one of ordinary skill in the art. In the next step, the support tubes (inflated separately) are pressurized to lift the outer tent sheet. The switch of the flow paths is triggered by pressure sensors (or by a pressure gauge in manual operation). Pressure maintenance or an increase in the interior pressures in case of side forces due to high wind speeds is effected in the same way.

Dismantling of the wall structure according to the invention is accelerated by sequentially drawing off the excess pressure.

Other objects, advantages and novel features of the present invention will become apparent from the following detailed description of the invention when considered in conjunction with the accompanying drawings.

DETAILED DESCRIPTION OF THE DRAWINGS

Figure 1:
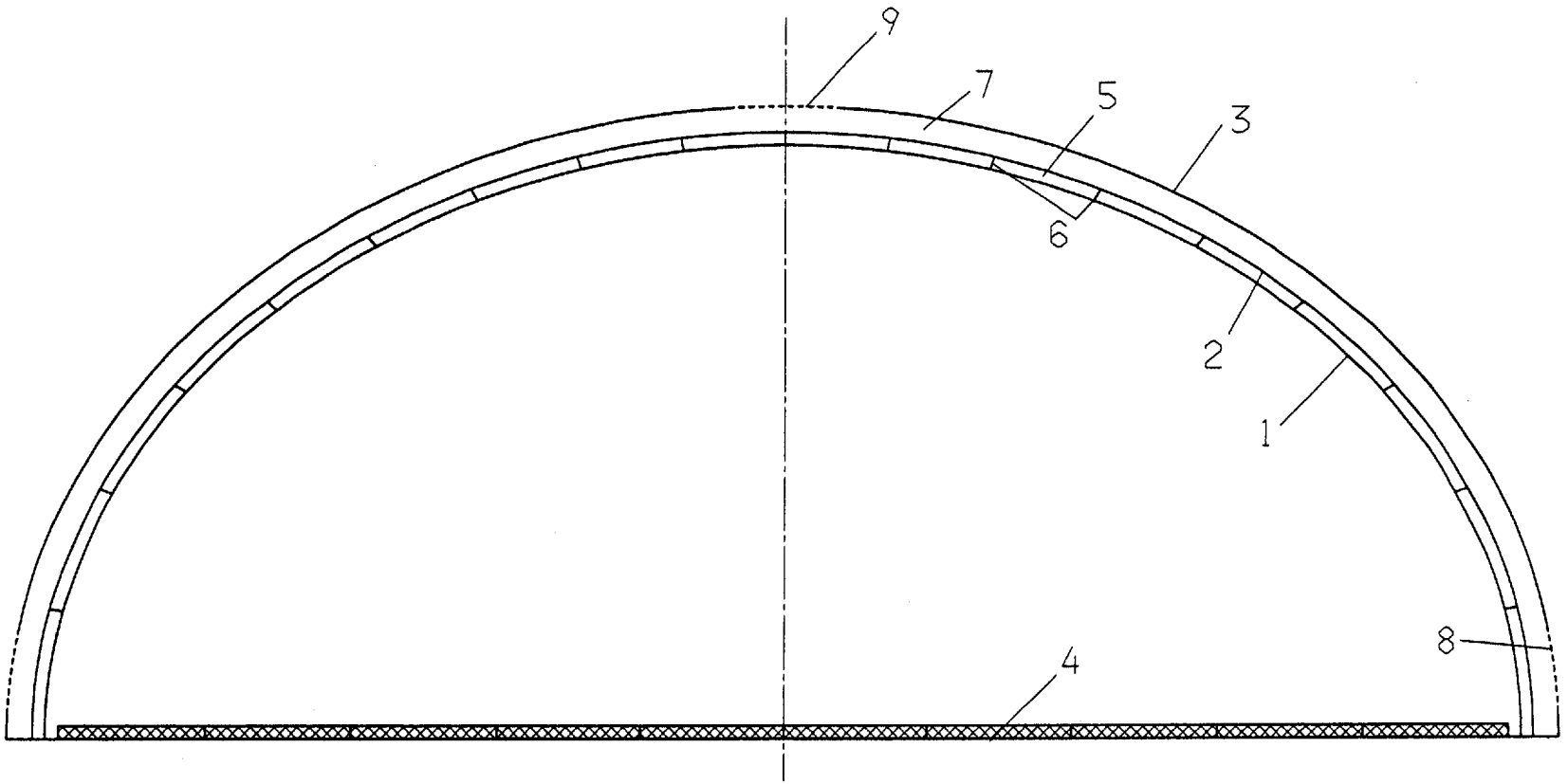
FIG. 1 is a cross section of a wall structure according to the invention.

FIG. 1 is a cross section of a pneumatic wall structure according to the invention. As shown, the wall structure is closed on three sides (left, right and top) and reaches all the way to the ground 4 on the sides. According to the invention, a lightweight thermal insulation (important for use in extreme temperatures) is formed by a two-layer configuration of the wall structure (inner layer 5, outer layer 7). The inner layer 5 is delimited by the inner tent sheet 1 and the central tent sheet 2, and the outer layer 7 is delimited by the central tent sheet 2 and the outer tent sheet 3 (the tent sheets are also referred to as foils below). The shape of the wall structure above the ground 4 is preferably elliptical or resembles a portion of an ellipse (in a vertical longitudinal section and cross section) to provide sufficient distance from the ground in the edge area while ensuring the smallest possible outer surface. The chamber forming the inner air layer 5 is partitioned by ribs 6 and supplied with an overpressure to hold the shape of the wall structure and to resist possible shelling. The air connection is ensured by non-return valves (not depicted). The foil distance between foil 1 and 2 is determined, on the one hand, by the required pneumatic rigidity for the given height of the room and, on the other hand, by the thermodynamic conditions of an optimal insulation for nearly vertical air layers, irrespective of the temperature, of approximately 50 mm.

Figure 2:
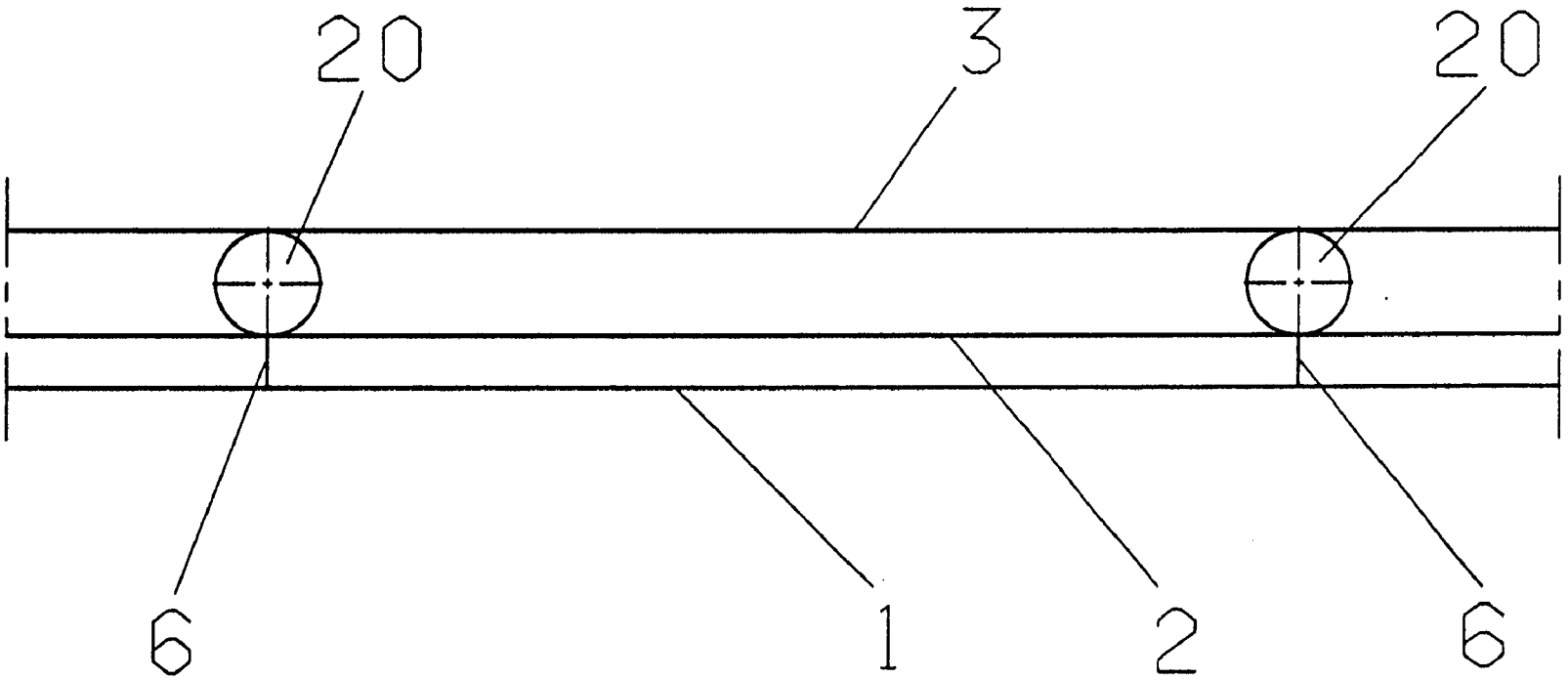
FIG. 2 is a longitudinal section of a detail of the wall structure according to the invention.

The outer air layer 7 communicates with the environment via air intake openings 8 near the ground and air outlet openings 9 near the roof ridge. The air intake openings 8 are screen-type openings. They extend along at least a partial area of the building circumference near the ground. The openings 8 can be closed, particularly if it rains, or in the winter. When the outer foil 3 heats up, an upwardly directed convection current is created in chamber 7 between the central foil 2 and the outer foil 3 which operates to conduct relatively high temperatures away from outer foil 3. The greater the distance selected between foils 2 and 3, the less the convection current heats the rising air due to the overheating of the outer foil 3. Consequently, the size of the distance between foil 2 and foil 3 can be determined by the diameter required for the rigidity of the support tubes 20 (FIG. 2). A preferred range is 75 to 120 mm. For military use, resistance to shelling with light weapons and to fragments may be desirable. This can be achieved by covering the outer foil 3 with a kinetic energy absorbing fabric, such as that known by the trade name KEVLAR™. The aforementioned pneumatic support tubes 20 are arranged within the outer layer 7 and act as an additional support structure and as spacers between the central foil 2 and the outer foil 3.

Figure 3:
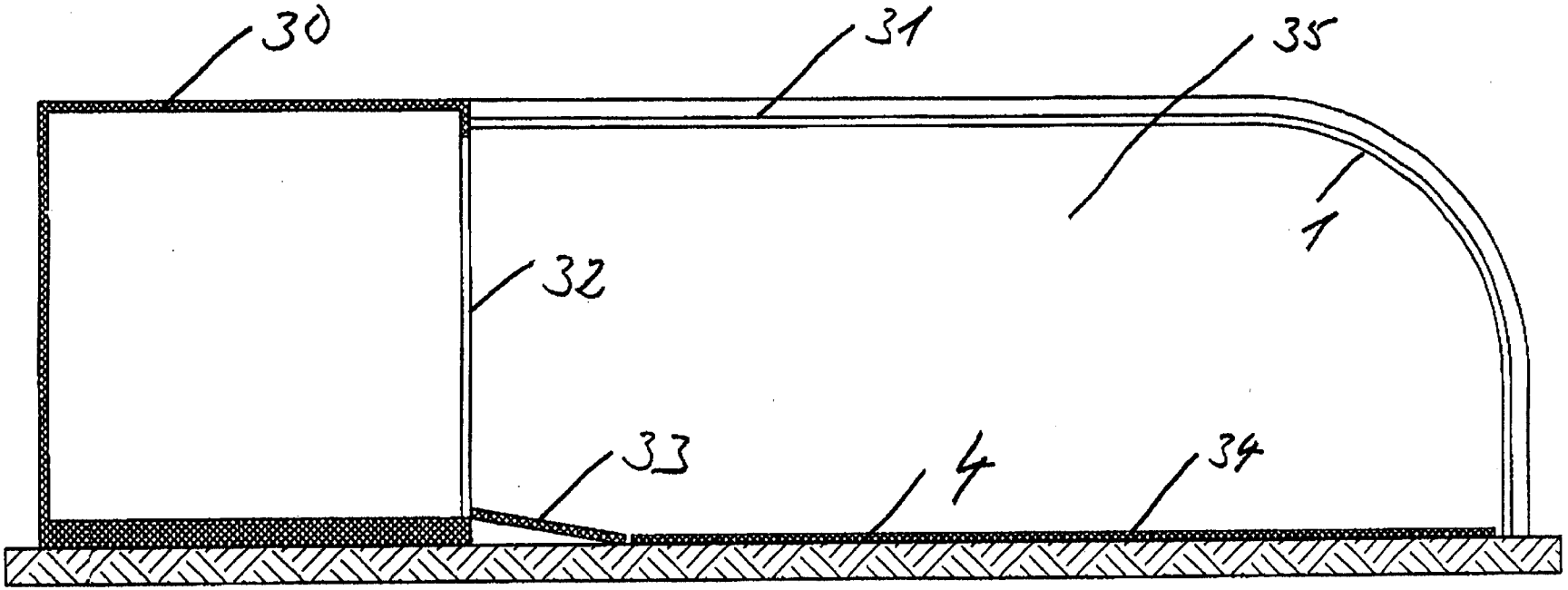
FIG. 3 is a wall structure according to the invention combined with a shelter.

FIG. 3 shows a wall structure 31 according to the invention combined with a container 30. The wall structure 31 may be entered through opening 32 on the long wall of the container. The door is preferably a flap 33, which can simultaneously act as a ramp to compensate the difference in floor height and serve as a pallet to pack the wall structure.

If the wall structure is intended as a passage or a space between two containers, a purely cylindrical construction with two vertical end faces is also feasible.

To exclude entry of possibly polluted exterior air through leaks in the building in the event of a CBR threat and for health reasons in general, the inner foil 1 of the support structure and the floor foil 4 covered with floor tiles 34 form a continuous envelope for an interior space 35.

Figure 4:
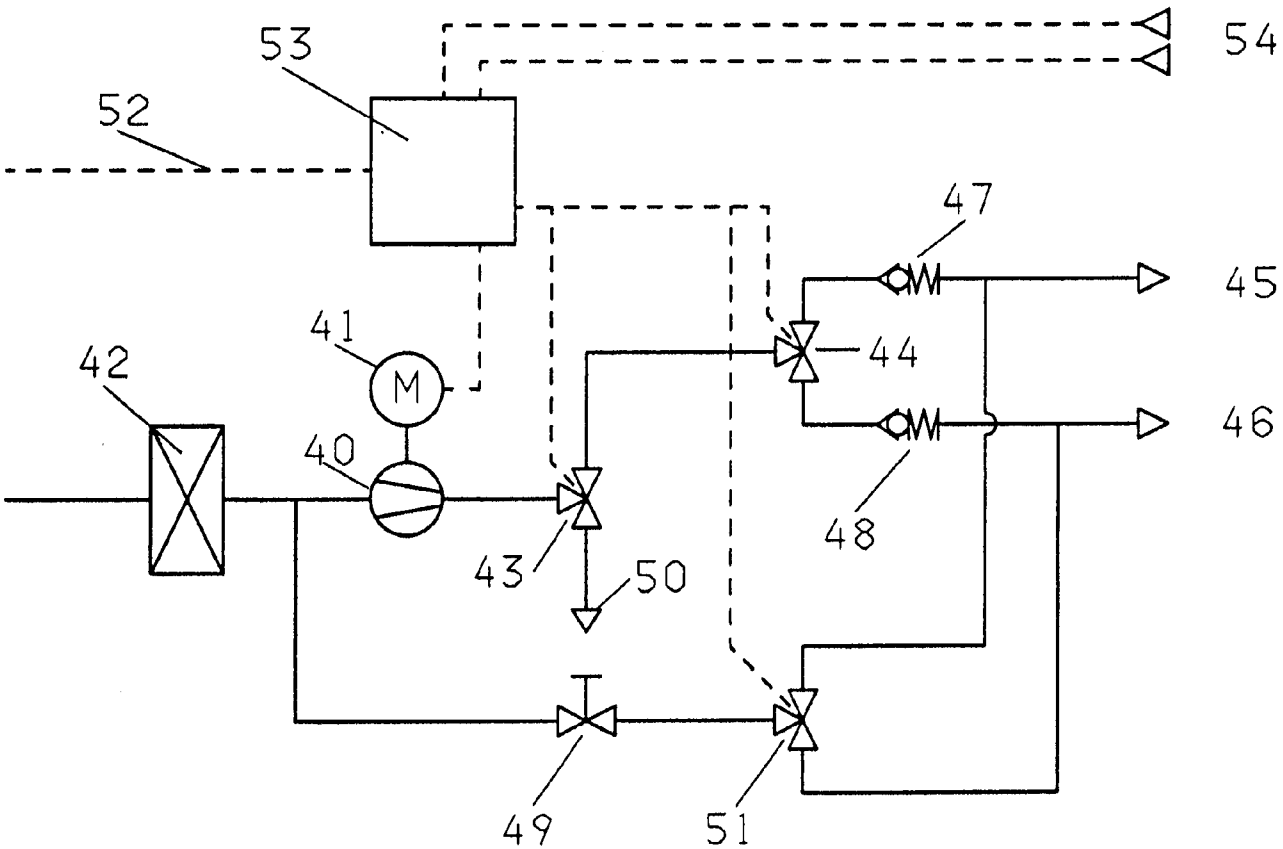
FIG. 4 is a block diagram of the compressed air supply with the valves for switching the flow paths.

The configuration of the compressed air supply and control is shown in a block diagram depicted in FIG. 4 and comprises an air compressor 40 with a motor 41 that sucks in the air through a filter 42. To inflate the pressure chambers, the compressed air is guided through the 3/2 solenoid valve 43 to a valve 44 of the same type and then sequentially to the main support structure (arrow 45) and the support tubes (arrow 46). The non-return valves 47, 48 prevent backflow.

To dismantle the pneumatic wall structure, i.e., to accelerate deflation of the overpressure by suction of the air compressor 40 and empty the air chambers, the stop valve 49 is first opened, then the 3/2 solenoid valve 43 is set to deflation in accordance with arrow 50, and finally evacuation is initiated along paths 46 and 45 with 3/2 solenoid valve 51.

The power for the compressed air equipment is supplied from a network of an independent energy system by way of line 52. A control 53, e.g., a programmable controller, receives the manual command to start the inflation or deflation process. The air pressure within the chambers is monitored by sensors (not shown), which communicate with the control device 53 by means of signal lines 54.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A wall comprising a two-layer structure formed by an inner, a central and an outer flexible tent sheet, wherein:

an inner layer delimited by the inner tent sheet and the central tent sheet is inflatable, and forms a main support structure of the wall;

an outer layer delimited by the central tent sheet and the outer tent sheet forms a convection space which is in communication with apertures in said outer tent sheet, and through which ambient air flows in a rising direction for providing heat insulation by conducting relatively high temperatures away from the outer tent sheet when the interior of the wall structure is being cooled; and inflatable support tubes are arranged between the central tent sheet and the outer tent sheet forming spacers and providing redundancy to the main support structure.

2. The wall as claimed in claim 1, wherein the inner layer is partitioned by ribs which are perforated, provided with holes, or are configured so that they only partially block the cross section, in order to suppress convection.

3. The wall as claimed in claim 1, wherein the central tent sheet along an outwardly facing side is provided with a coating that reflects thermal radiation.

4. The wall as claimed in claim 1, wherein the outer tent sheet has closeable air intake openings near a floor portion of the wall structure.

5. The wall as claimed in claim 1, wherein the outer tent sheet is equipped with closeable air outlet openings in a roof ridge area of the pneumatic wall structure so that the ambient air rising within the outer layer can escape.

6. The wall as claimed in claim 1, wherein an erection and a dismantling process with respect to an inflation and a pressure relief of the inner layer and the outer layer is sequential and program controlled.

7. The wall as claimed in claim 1, wherein the outer tent sheet is formed by or is reinforced with an energy absorbing fabric mat which protects the wall structure against shelling by weapons and against fragments.

8. A pneumatic wall structure comprising:

an inner flexible tent sheet;

a central flexible tent sheet; and an outer flexible tent sheet;

wherein the inner, the central and the outer flexible tent sheets are arranged to form a two-layer wall structure comprising (i) an inner layer formed by the inner tent sheet and the central tent sheet and (ii) an outer layer formed by the central tent sheet and the outer tent sheet; and wherein the inner layer is inflatable and provides a main support structure for the wall structure, and the outer layer forms a convection space which is in communication with apertures in said outer sheet, and through which ambient air is capable of flowing;

wherein inflatable support tubes are arranged between the central tent sheet and the outer tent sheet to provide redundancy to the main support structure and to provide a spacer between the central tent sheet and the outer tent sheet.

9. The pneumatic wall structure as claimed in claim 8, wherein the inner layer is partitioned by ribs for suppressing convection.

10. The pneumatic wall structure as claimed in claim 8, wherein the outer layer is in communication with ambient air by way of closeable air intake openings formed in the outer tent sheet.

11. The pneumatic wall structure as claimed in claim 10, wherein the outer tent sheet comprises closeable air outlet openings such that ambient air entering the outer layer is capable of forming a convection current which flows through the outer layer and conducts heat away from the outer tent sheet.

12. The pneumatic wall structure as claimed in claim 8, wherein the outer layer is capable of being filled with air and sealed to provide heat insulation.

13. The pneumatic wall structure as claimed in claim 8, wherein the outer tent sheet is formed by or is reinforced with an energy absorbing fabric mat which protects the wall structure against shelling by weapons and against fragments.

14. A method of making a pneumatic wall structure comprising:

providing an inner, a central and an outer flexible tent sheet;

arranging the inner, the central and the outer flexible tent sheets to form a two-layer wall structure comprising (i) an inner layer formed by the inner tent sheet and the central tent sheet and (ii) an outer layer formed by the central tent sheet and the outer tent sheet, wherein the inner layer is inflatable to provide a main support structure for the pneumatic wall structure and the outer layer forms a convection space is in communication with apertures in said outer sheet, and through which an ambient air is capable of flowing; and arranging inflatable support tubes between the central tent sheet and the outer tent sheet to provide redundancy to the main support structure and spacers between the central tent sheet and the outer tent sheet.

15. A method of erecting a pneumatic wall structure, the pneumatic wall structure comprising an inner, a central and an outer flexible tent sheet, the flexible tent sheets being arranged to form a two-layer wall structure comprising (i) an inner layer formed by the inner tent sheet and the central tent sheet and (ii) an outer layer formed by the central tent sheet and the outer tent sheet, the method comprising:

inflating the inner layer to provide a main support structure for the pneumatic wall structure and the outer layer forms a convection space into which an ambient air is capable of flowing;

inflating the support tubes to provide redundancy to the main support structure; and allowing ambient air to flow into the outer layer which forms a convection space coupled in communication with ambient atmosphere via apertures in said outer tent sheet.

16. A pneumatic enclosure having a wall structure comprising:

an inflatable inner layer delimited by first and second flexible sheets; and an outer layer delimited by said second flexible sheet and a third flexible sheet;

said outer flexible sheet having apertures therethrough which connect said outer layer with ambient atmosphere external to said enclosure, whereby, in a deployed state of said pneumatic structure, said outer layer between said second and third flexible sheets is maintained at ambient air pressure, and ambient air is permitted to circulate through said outer layer between said second and third flexible sheets; and said inflatable inner layer being inflated in said deployed state of said pneumatic structure.

* * * * *